US010107228B2

(12) United States Patent
Sharma et al.

(10) Patent No.: US 10,107,228 B2
(45) Date of Patent: Oct. 23, 2018

(54) INTERNAL COMBUSTION ENGINE CYLINDER LINER FLANGE WITH NON-CIRCULAR PROFILE

(71) Applicant: CUMMINS INC., Columbus, IN (US)

(72) Inventors: Priyesh Sharma, Seymour, IN (US); Neal R. Phelps, Bargersville, IN (US); Jameson L. Smith, Columbus, IN (US); Gajanan B. Nirwal, Pune (IN); Kevin A. Brittain, Greenwood, IN (US)

(73) Assignee: CUMMINS INC., Columbus, IN (US)

( * ) Notice: Subject to any disclaimer, the term of this patent is extended or adjusted under 35 U.S.C. 154(b) by 0 days.

(21) Appl. No.: 15/558,062

(22) PCT Filed: Mar. 31, 2015

(86) PCT No.: PCT/US2015/023510
§ 371 (c)(1),
(2) Date: Sep. 13, 2017

(87) PCT Pub. No.: WO2016/159970
PCT Pub. Date: Oct. 6, 2016

(65) Prior Publication Data

US 2018/0066601 A1 Mar. 8, 2018

(51) Int. Cl.
*F02F 1/10* (2006.01)
*F02F 1/16* (2006.01)

(52) U.S. Cl.
CPC ..... *F02F 1/16* (2013.01); *F02F 1/163* (2013.01)

(58) Field of Classification Search
CPC ..... F02F 1/16
See application file for complete search history.

(56) References Cited

U.S. PATENT DOCUMENTS 1,575,638 A 3/1923 Pochobradsky et al.
3,389,693 A * 6/1968 Herschmann ..... F02F 1/16 123/41.84
3,800,751 A 4/1974 Glassey et al.
5,251,578 A 10/1993 Kawauchi et al.
(Continued)

FOREIGN PATENT DOCUMENTS

EP 0 525 967 2/1993

OTHER PUBLICATIONS

International Preliminary Report on Patentability dated Oct. 3, 2017 in PCT/US2015/023510.
(Continued)

*Primary Examiner* — Hung Q Nguyen
(74) *Attorney, Agent, or Firm* — Faegre Baker Daniels LLP

(57) ABSTRACT

Various embodiments of the invention relate to an apparatus and method for assembling a cylinder for an internal combustion engine. The cylinder includes a cylinder liner with a liner wall having an outer diameter and a flange extending radially outward from the liner wall at a superior end of the liner wall. The flange includes a fillet region adjacent to the liner wall having an inferior surface. The inferior surface has a contour defined at least partially by a non-circular profile. The contour defines a minimum diameter that is greater than or equal to an outer diameter of the liner wall. The non-circular profile is optionally defined by a slanted ellipse.

20 Claims, 7 Drawing Sheets

(56) References Cited

U.S. PATENT DOCUMENTS

| | | | | |
|---|---|---|---|---|
| 5,402,754 | A * | 4/1995 | Gunnarsson | F02F 1/16 123/193.2 |
| 5,979,374 | A | 11/1999 | Jackson | |
| 6,328,001 | B1 | 12/2001 | Kirtley et al. | |
| 2005/0279296 | A1* | 12/2005 | Coney | F02B 77/11 123/41.84 |
| 2006/0219192 | A1 | 10/2006 | Rasmussen | |
| 2013/0133608 | A1 | 5/2013 | Vilhelmsson et al. | |

OTHER PUBLICATIONS

International Search Report and Written Opinion dated Jul. 1, 2015 in PCT/US2015/023510.

* cited by examiner

INTERNAL COMBUSTION ENGINE CYLINDER LINER FLANGE WITH NON-CIRCULAR PROFILE

CROSS-REFERENCE TO RELATED APPLICATIONS

The present application is a national phase filing under 35 U.S.C. § 371 of International Application No. PCT/US2015/023510, titled "INTERNAL COMBUSTION ENGINE CYLINDER LINER FLANGE WITH NON-CIRCULAR PROFILE," filed on Mar. 31, 2015, the entire disclosures of which being expressly incorporated herein by reference.

TECHNICAL FIELD

The present disclosure relates to internal combustion engines. In particular, this disclosure relates to a cylinder liner for an internal combustion engine.

BACKGROUND

Internal combustion engines often comprise a cylinder block having a plurality of cylinders for containing the combustion events that provide power to pistons. Combustion events create substantial pressure and heat. Cylinder liners typically are included in the cylinder to form a combustion chamber by lining the cylinder block to isolate the cylinder block from combustion. Cylinder liners must also be cooled to prevent overheating of the combustion chamber. Cooling is often accomplished with a cooling jacket around the liner for containing a fluid for heat transfer. The presence of a cooling jacket leaves at least some portions of the cylinder liner unreinforced by, or without support from, the cylinder block. The stresses on the cylinder liner from combustion and engine operation may lead to unwanted failures and fatigue, especially in large bore cylinders wherein the larger size of the cylinder liner, higher pressures, and higher temperatures result in higher thermos-mechanical loads on various portions of the cylinder liner. There remains a continuing need for cylinder liner designs that can properly withstand the mechanical stresses and fatigue induced by combustion at unreinforced portions.

SUMMARY

Various embodiments of the present disclosure relate to a cylinder liner for an internal combustion engine that comprises a liner wall having an outer diameter and a flange extending radially outward from the liner wall at a superior end of the liner wall. The flange has an inferior surface. The flange includes a fillet region adjacent to the liner wall and extends radially outward from the liner wall. The inferior surface in the fillet region has a contour, and the contour is defined at least partially by a non-circular profile. A seating region extends radially outward from the fillet region, and the inferior surface in the seating region is structured to engage a cylinder block. The profile defines a minimum diameter that is greater than or equal to the outer diameter of the liner wall.

In some embodiments, the height of the contour in an axial direction is greater than a width of the contour in the radial direction. Optionally, the non-circular profile is defined by one of an ellipse, a hyperbola, and a parabola. In further embodiments, the non-circular profile is a slanted ellipse.

Some embodiments of the present disclosure relate to a cylinder in an internal combustion engine that comprises a cylinder bore formed in a cylinder block and a cylinder liner disposed in the cylinder bore. The cylinder liner includes a liner wall having an outer diameter and a flange extending radially outward from the liner wall at a superior end of the liner wall. The flange has an inferior surface, and the flange includes a fillet region and a seating region. The fillet region is adjacent to the liner wall and extends radially outward from the liner wall, and the inferior surface in the fillet region has a contour. The seating region extends radially outward from the fillet region, and the inferior surface in the seating region is structured to engage the cylinder block. The contour defines a minimum diameter that is greater than or equal to the outer diameter of the liner wall and is defined at least partially by a non-circular profile.

Yet further embodiments of the present disclosure relate to a method of assembling a cylinder that comprises providing a cylinder block having a cylinder bore formed therein; providing a cylinder head; providing a cylinder liner; inserting the cylinder liner into the cylinder bore of the cylinder block; and clamping the cylinder head over the cylinder bore to compress the seating region of the flange. The cylinder liner includes a liner wall having an outer diameter. A flange extends radially outward from the liner wall at a superior end of the liner wall, and the flange has an inferior surface. The flange includes a fillet region and a seating region, and the fillet region is adjacent to the liner wall and extends radially outward from the liner wall. The inferior surface in the fillet region has a contour, and the seating region extends radially outward from the fillet region. The inferior surface in the seating region is structured to engage a cylinder block. The elliptical contour defines a minimum diameter that is greater than or equal to the outer diameter of the liner wall and is defined at least partially by a non-circular profile.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1:
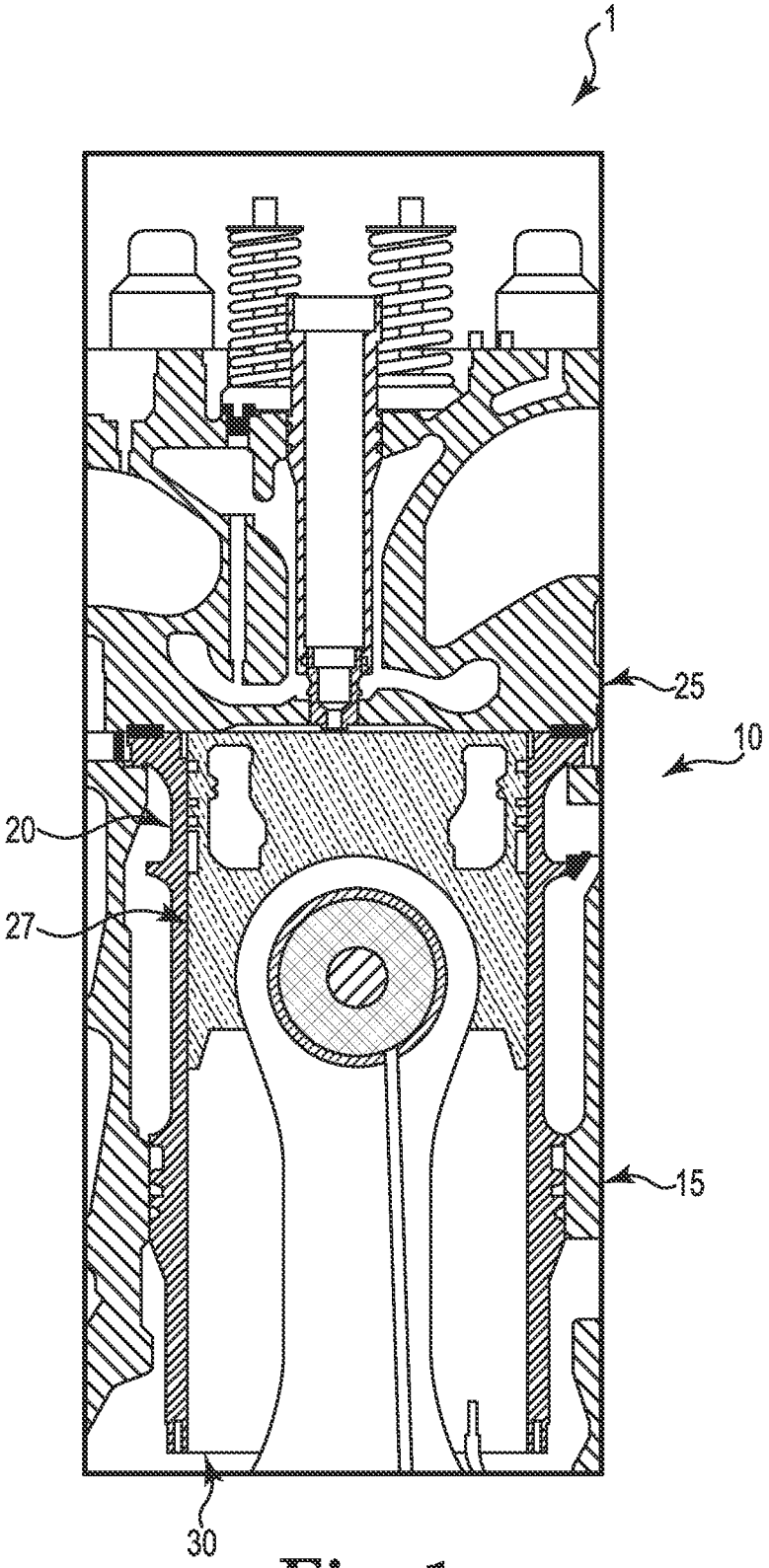
FIG. 1 is a cross-sectional and partial view showing an internal combustion engine including a cylinder assembly according to some embodiments.

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION

FIG. 1 is a cross-sectional and partial view showing an internal combustion engine 1 including a cylinder 10, or cylinder assembly, according to some embodiments. The example internal combustion engine 1 also includes a cylinder block 15. A cylinder bore 30 is formed as a space in the cylinder block 15. As shown, the example cylinder liner 20 is disposed in the cylinder bore 30. Example cylinder 10 includes a combustion chamber that is at least partially defined, or bounded, by the example cylinder liner 20 and a cylinder head 25. As illustrated, the cylinder head 25 defines a superior boundary of the combustion chamber. The cylinder head 25 may define an inferior boundary, or any other boundary, in various embodiments, as the cylinder 10 may be oriented in one of many directions. The cylinder head 25 is clamped or secured to the cylinder block 15 by studs or any other means suitable for securing the cylinder head. A portion of the cylinder liner 20 is compressed between the cylinder head 25 and the cylinder block 15 to at least partially secure the cylinder liner to the cylinder block 15. A piston 27 defines the inferior boundary of the combustion chamber. The example cylinder liner 20 defines the lateral boundaries of the combustion chamber. As shown, the piston 27 is at a top dead center position, and the example combustion chamber has a minimum volume in this state.

Figure 2:
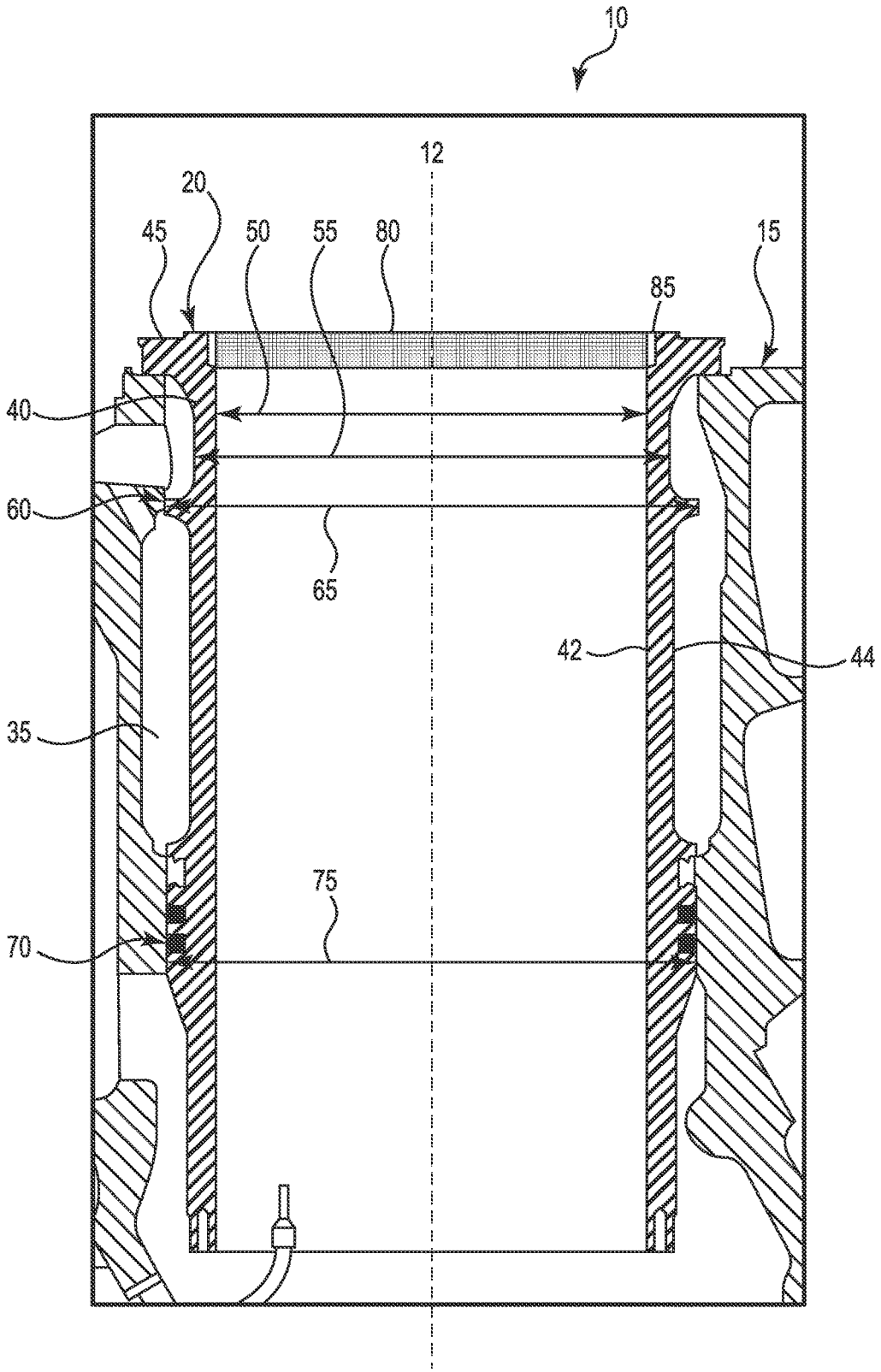
FIG. 2 is a cross-sectional and partial view showing further detail of the cylinder of FIG. 1 free from a cylinder head and a piston.

FIG. 2 is a cross-sectional and partial view showing further detail of the cylinder 10 free from the cylinder head 25 and the piston 27 according to some embodiments. The illustrated embodiment represents, for example, a state of the cylinder 10 during assembly or disassembly. An axis of the cylinder 10 is aligned to a longitudinal axis 12 shown for illustrative purposes. The example cylinder bore 30 (as shown in FIG. 1) includes a space for defining a cooling jacket 35. The cooling jacket 35 is a space for receiving a fluid, such as a coolant for transferring heat generated by a combustion event away from the cylinder 10, its components (e.g., the cylinder liner 20), and the combustion chamber. At least a portion of the example cooling jacket 35 is defined as a space between the cylinder block 15 and the cylinder liner 20.

The example cylinder liner 20 includes a liner wall 40. As shown, the liner wall 40 extends generally the full length of the cylinder liner 20. The example liner wall 40 has an inner surface 42 and an outer surface 44. The example inner surface 42 provides a guide for the piston 27 (as shown in FIG. 1) to slide and travel longitudinally during a combustion cycle. The inner surface 42 is generally uniform to provide smooth travel. The outer surface 44 is generally non-uniform. The example outer surface 44 incorporates a plurality of features for improving the functionality of the cylinder liner 20.

As shown, the example cylinder liner 20 includes a flange 45. The example flange 45 extends radially outward from the liner wall 40. The flange 45 includes a portion to assist in seating the cylinder liner 20 on the cylinder block 15 for axial location control. The flange 45 is described herein elsewhere in more detail.

Various embodiments of the liner wall 40 have an inner diameter 50 and an outer diameter 55. The example diameters 50, 55 are centered at the longitudinal axis 12. Each diameter defines a circumference of the liner wall 40 also centered about the longitudinal axis 12. As shown, the example inner diameter 50 is uniform throughout the longitudinal extent of the liner wall 40. The example outer diameter 55 is uniform in some portions in the longitudinal direction along the liner wall 40. For example, as illustrated, the outer diameter 55 defines a minimum outer diameter of the liner wall 40 for withstanding the forces generated due to a combustion event. In some embodiments (not shown), the example outer diameter 55 may also vary in some portions to a greater diameter.

The example cylinder liner 20 includes an optional radial control region 60 for radial location control. An example radial control region 60 is formed as an annulus. Radial location control, for example, includes resisting movement of the cylinder liner 20 in the radial direction with respect to the cylinder block 15. The radial control region has an outer diameter 65. At one or more regions along the outer surface of the radial control region 60 at the outer diameter 65, the radial control region 60 of the cylinder liner 20 contacts the cylinder block 15. At one or more other regions along the outer surface of the radial control region 60, the radial control region 60 does not contact the cylinder block 15, which allows the fluid in the cooling jacket 35 to flow past the radial control region 60. In the example internal combustion engine 1, fluid flows from a lower section of the cooling jacket 35 to the upper section of the cooling jacket 35, which is in fluid communication with said lower section. Generally, the outer diameter 65 of the radial control region is greater than the outer diameter 55 of the liner wall 40. Other configurations of the radial control are contemplated within this disclosure. For example, various embodiments of the cylinder 10 (not shown) include a radial control region 60 formed integrally with the flange 45.

Additionally, the example cylinder liner 20 includes an optional sealing region 70. The sealing region 70 provides a seal between the cylinder liner 20 and the cylinder block 15. Also, the example sealing region 70 optionally provides a boundary to define the cooling jacket 35 for holding the fluid. The sealing region 70 optionally includes sealing rings, which may be made of a rubber or other suitable material. The example sealing region 70 includes an outer diameter 75 different than the outer diameter 55 of the liner wall 40. As shown, the outer diameter 75 of the sealing region 70 is greater than the outer diameter 55 of the liner wall 40.

An anti-polishing ring (APR) 80 is also shown as part of the example cylinder 10. The APR 80 reduces the carbon deposition on the top portion of the piston 27. The APR 80 is disposed in an APR groove 85 formed in the cylinder liner 20. Specifically, the APR groove 85 is formed in an inner surface 42 of the liner wall 40. The APR 80 also requires cooling during engine operation.

The example cylinder liner 20 is generally defines a cylindrical combustion chamber. The example combustion chamber has a circular cross-section, which defines a corresponding shape of the piston 27 (as shown in FIG. 1). Other shapes are contemplated within this disclosure.

The features of the example cylinder liner 20 cooperate to limit the axial and lateral extent of combustion in the combustion chamber so that pressure from the combustion event is directed to the piston head for power delivery to the internal combustion engine. In particular, the example flange 45 provides axial location control to the cylinder liner 20 under compression forces from the clamped cylinder head 25 (as shown in FIG. 1) while also providing resistance to additional stresses from combustion initiated adjacent to the flange 45 (e.g., at top dead center). The example cylinder liner 20 may be manufactured by any known methods, such as the machining of any suitable material, for example, a grey cast iron alloy.

Figure 3:
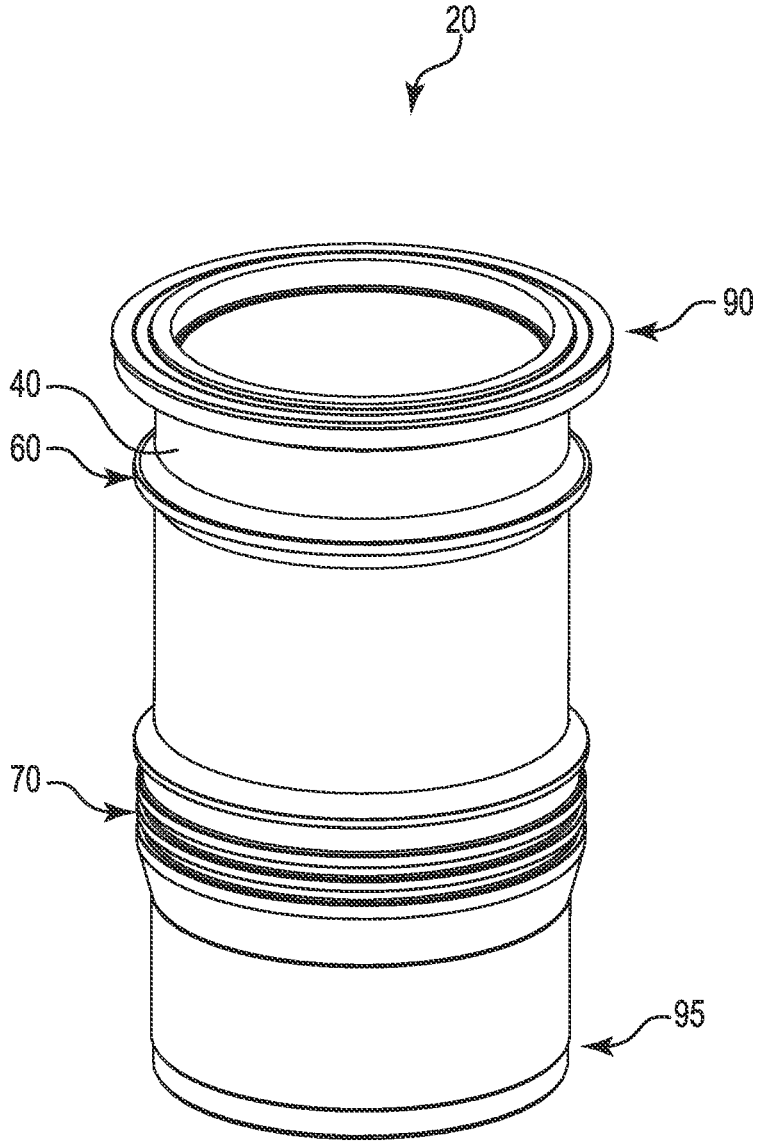
FIG. 3 is an isometric view showing the cylinder liner of FIG. 1.

FIG. 3 is an isometric view showing the cylinder liner 20 according to some embodiments. The example cylinder liner 20 has a superior end 90 and an inferior end 95. Between those ends, extends liner wall 40 of the cylinder liner 20. Disposed along the liner wall 40 is a radial control region 60 and a sealing region 70.

Figure 4:
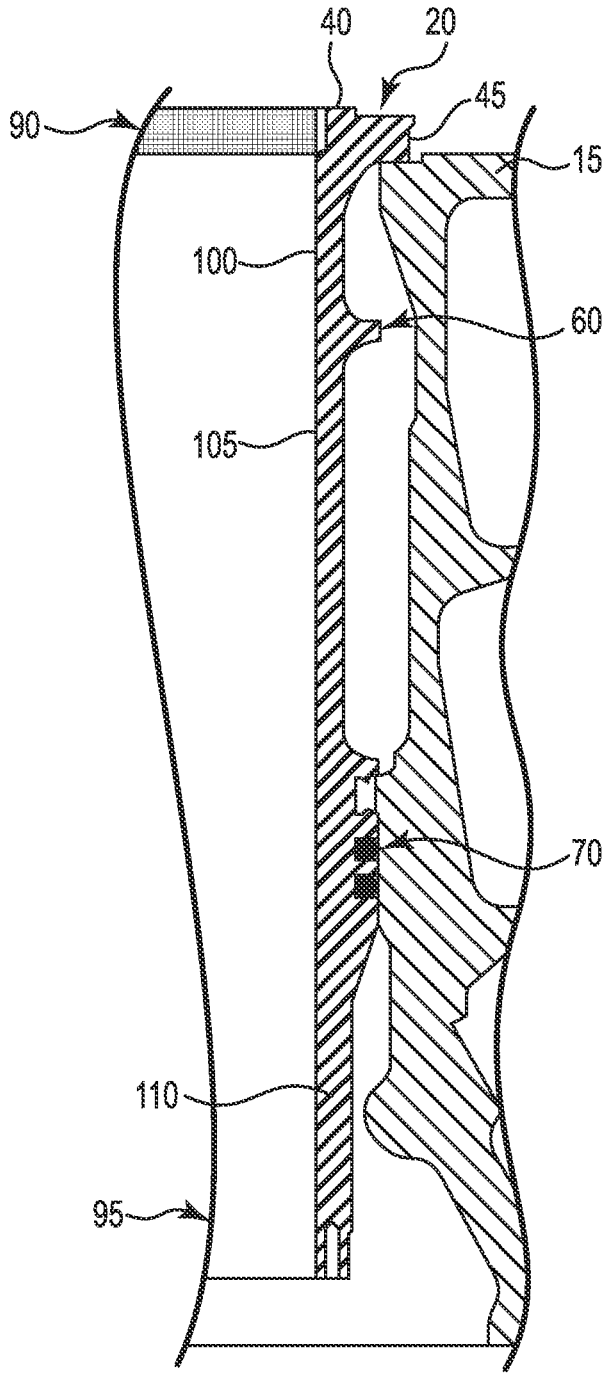
FIG. 4 is a cross-sectional and partial view showing detail of the liner wall of the cylinder liner of FIG. 1.

FIG. 4 is a cross-sectional and partial view showing detail of the liner wall 40 of the cylinder liner 20 according to some embodiments. The example liner wall 40 extends between the superior end 90 and the inferior end 95. The example cylinder liner 20 engages the cylinder block 15 at the superior end 90. The example cylinder liner 20 also engages the cylinder block 15 at radial control region 60 and at sealing region 70.

The example radial control region 60 is inferior to the flange 45. Between the radial control region 60 and the flange 45 is a first portion 100 of the liner wall 40. The first portion 100 has a first thickness. The example first thickness is a minimum thickness for resisting combustion forces along the liner wall 40.

Between the radial control region 60 and sealing region 70 is a second portion 105 of the liner wall 40. The example second portion 105 has a second thickness equal to the first thickness of first portion 100. In other embodiments (not shown), the second thickness is greater than the first thickness of first portion 100 or thicker than the minimum thickness of the liner wall 40. Generally, the outer diameter of the first portion 100 is constant throughout the length of the first portion 100 between the flange 45 and the radial control region 60. The example flange 45 and the example radial control region 60 have outer diameters that are equal to or greater than the minimum diameter of the liner wall 40 or the first portion 105. Example boundaries or transitions between the flange 45, the first portion 100 and radial control region 60 do not include an outer diameter less than the minimum outer diameter (e.g., diameter 55) of the liner wall 40.

Between the sealing region 70 and the inferior end 95 is a third portion 110 of the liner wall 40. The example third portion 110 has a third thickness greater than the first thickness of the first portion 100 or the minimum thickness of the liner wall 40. The third thickness of the third portion 110 is optionally greater than the thickness of the second portion 105. In alternative embodiments (not shown), the third thickness is equal to the minimum thickness of the liner wall 40.

The radial control region 60 is optionally located at any of one or more locations along the liner wall from the superior end 90 to the inferior end 95. The example sealing region 70 is disposed near a middle of the liner wall 40. In some embodiments (not shown), the sealing region 70 is disposed on the liner wall 40 at a location at an inferior end of the liner wall 40.

Figure 5:
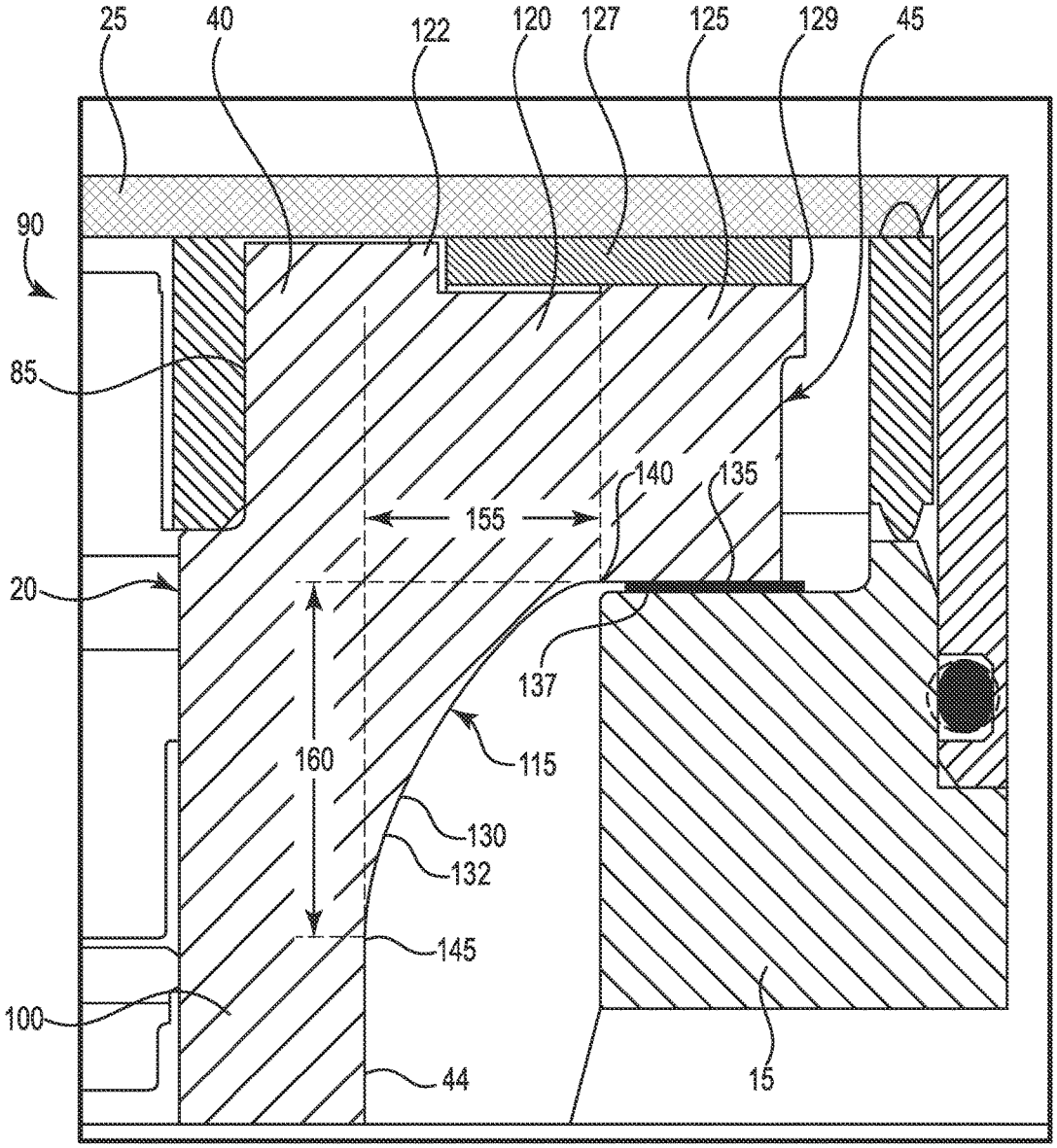
FIG. 5 is a cross-sectional and partial view showing a flange of the cylinder liner of FIG. 1 assembled with the cylinder head.

FIG. 5 is a cross-sectional and partial view showing detail of the flange 45 of the cylinder liner 20 assembled with the cylinder head 25 according to some embodiments. The flange 45 extends radially outwardly from the liner wall 40 and has an inferior surface 115. The example flange 45 includes a fillet region 120 and a seating region 125 extending radially outwardly from the fillet region 120. The example inferior surface 115 is defined in the fillet region 120 as inferior surface or contour 130. The example inferior surface 115 is defined in the seating region 125 as inferior surface or seating surface 135. Example inferior surface 135 engages a liner seal 137. The example liner seal 137 helps to contain the cooling fluid in the cooling jacket 35 (as shown in FIG. 2).

The cylinder head 25 applies clamping forces to the cylinder liner 20 that introduce stresses on the cylinder liner 20 at a region near the superior end 90, also known as a top ring region (TRR). In particular, stresses are introduced at the liner wall 40 adjacent to the flange 45. The presence of the APR groove 85 may further increase stresses at the region of the cylinder liner 20 due to the reduced amount of cylinder liner material.

Along a superior surface of the example flange 45 is a fire dam 122. The example fire dam 122 is formed as a shoulder that creates a recess for gasket 127. The example gasket 127 is seated in the recess and extends outwardly from the fire dam 122. The gasket 127 is compressed between the cylinder head 25 and the cylinder liner 20 to contain the combustion radially inwardly therefrom. The flange 45 also has a handling feature 129. The example handling feature 129 is a protrusion or lip extending radially outward for manipulating the position of the cylinder liner 20, for example, during assembly or disassembly. As shown, the example fire dam 122 is formed in the fillet region 120 with the example gasket 127 extending from the fillet region to the seating region 125, and the handling feature 129 extends from the seating region 125. Other arrangements (not shown) are contemplated to combustion while enhancing handling of the cylinder liner 20.

The fillet region inferior surface or contour 130 has a maximum radial width 155 and a maximum axial height 160. The contour 130 transitions between the example outer surface 44 of the liner wall 40 and the example seating surface 135, which are perpendicular or orthogonal to each other in the illustrated embodiment. The example outer surface 44 and the example contour 130 meet at a boundary 145. The example boundary 145 is also adjacent to the first portion 100 of the liner wall 40. The example contour 130 and the example seating surface 135 meet at a boundary 140. Generally, the contour radial width decreases from the maximum radial width 155 along an axially inferior direction, and the contour axial height gradually decreases from the maximum axial height 160 along a radially outward direction. The example contour 130 is at least partially defined by a profile 132 and is designed to improve stress results and thermo-mechanical fatigue (TMF) strength over other flange designs as described in more detail herein elsewhere. The example contour 130, as shown, is defined by a non-circular profile 132. In some embodiments (not shown), the inferior surface of the fillet region 120 includes other features than the example profile 132.

Figure 6:
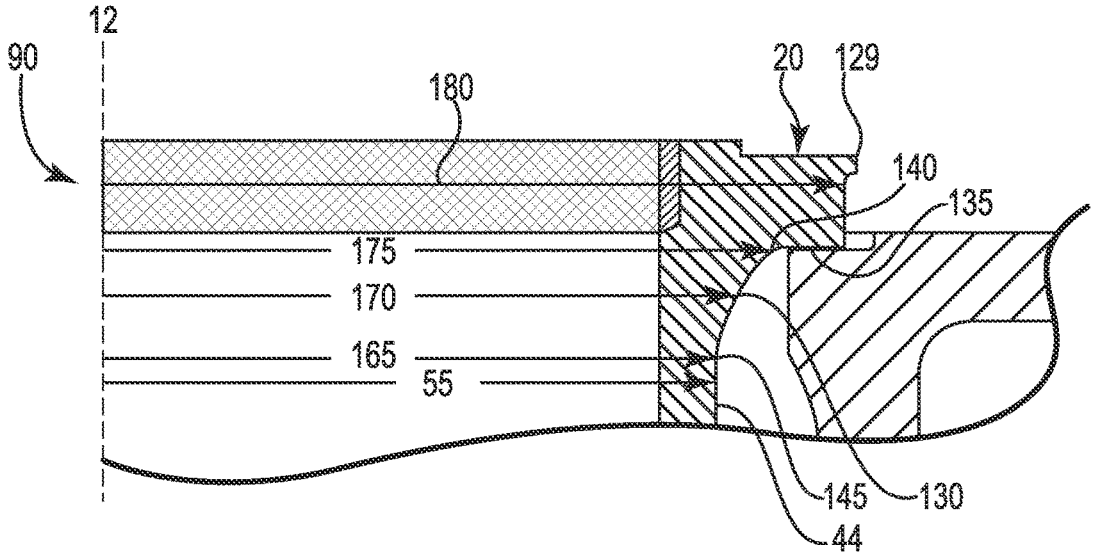
FIG. 6 is a cross-sectional and partial view showing half of the superior end of the cylinder liner of FIG. 1.

FIG. 6 is a cross-sectional and partial view showing half of the superior end 90 of the cylinder liner 20 extending radially outward from longitudinal axis 12 free of the cylinder head 25 according to some embodiments. The example cylinder liner 20 defines a plurality of diameters and relationships between those diameters. The radial extent of the diameters extending from the longitudinal axis 12 corresponds to the radius for each diameter.

The outer diameter 55 of the liner wall 40 defines a minimum outer diameter for the cylinder liner 20. The diameter 165 is defined at the boundary 145 of the contour 130 and the outer surface 44 of the liner wall 40.

The diameter 170 is defined by the contour 130. The example diameter 170 changes in the axial direction, and as shown, increases along the axially superior direction. The example diameter 165 defines a minimum for diameter 170 of the example contour 130.

Diameter 175 is defined at the boundary 140 of the contour 130 and the seating surface 135. The example diameter 175 defines a maximum for diameter 170 of the example contour 130.

The outer diameter 180 of the flange 45 is defined by the radial extent of the flange 45 inferior to the example handling feature 129. Generally, the outer diameter 180 is constant in diameter through the axial extent of the flange 45 or the extent of the flange 45 inferior to the handling feature 129 when present. The diameter 170 of the contour 130 is generally less than the outer diameter of the flange 180.

Figure 7:
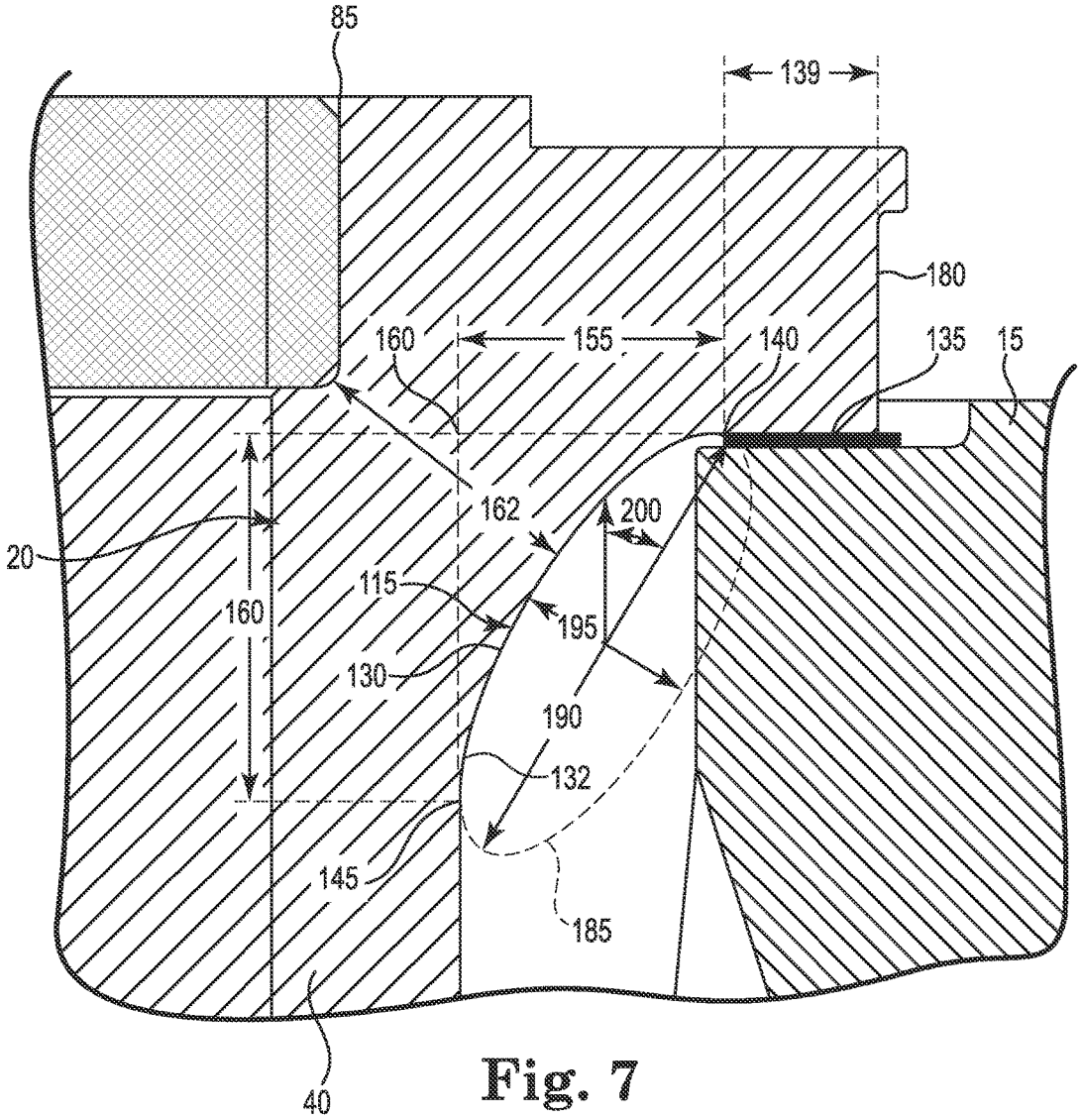
FIG. 7 is a cross-sectional and partial view showing further detail of a profile of the flange of FIG. 5.

FIG. 7 is a cross-sectional and partial view showing detail of the example contour 130 having a non-circular profile 132 according to some embodiments. As illustrated, the example ellipse 185, shown for illustrative purposes, defines the shape or path of the example non-circular profile 132 of the inferior surface 115 along a cross section. The example ellipse 185 is tangential to the seating surface 135. The other end of the example ellipse 185 is tangential to the outer surface 44 of the liner wall 40.

The ellipse 185 is a mathematical construct defined as shown by a major axis 190, a minor axis 195, and an angle 200. The example angle 200 is a slant or oblique angle from a direction parallel to the longitudinal axis 12 (shown elsewhere). As is known in the art, an ellipse is an oval shape traced by a point moving in a plane so that the sum of its distances to two other points, or foci, is constant. An ellipse is also a conic section defined by the intersection of a cone and an oblique plane when the plane cuts the cone and does not intersect the base of the cone.

In some embodiments, the non-circular profile 132 is a conic section. An ellipse is one example of a non-circular conic section. Other examples include a hyperbola and a parabola. As known in the art, one definition of a hyperbola is a curve traced by a point moving in a plane so that the difference of its distances to two other points is constant. Another definition of a hyperbola is a conic section defined by the intersection of a cone and an oblique plane when the plane cuts the cone at an angle to the cone axis less than the angle to the surface of the cone. Further, as known in the art, one definition of a parabola is a curve traced by a point moving in a plane so that the difference of its distance to another point (the focus) and its shortest distance to a line (directrix) are constant. Another definition of a parabola is a conic section defined by the intersection of a cone and a plane when a plane parallel to the surface of the cone cuts the cone at a distance offset from that surface.

The parameters of the ellipse 185, which include the axes 190, 195 and the angle 200, are selected to improve performance in the stress and/or TMF strength of the cylinder liner 20. The presence of an optional APR groove 85 decreases the amount of material 162 between the contour 130 and the space formed in the APR groove 85. The ellipse parameters are optionally adjusted in response to the APR groove 85 size or location.

The axes 190, 195 and the angle 200 may be selected, for example, in response to one or more parameters, such as cylinder liner inner diameter, cylinder liner outer diameter, liner wall thickness, cylinder block inner diameter, liner mass or volume, flange outer diameter, flange height, flange mass or volume, presence of an APR groove, size of the APR groove, location of the APR groove, location of the TRR region, cylinder material, cylinder volume, size of the radial control region, and position of the radial control region, among others. A person having ordinary skill in the art, and having the benefit of the disclosure herein, would be able to select the appropriate axes and angles for the ellipse 185 to form the contour 130 for improved performance. Such improvements may also be optimums or maximums for the particular cylinder.

In the illustrated embodiment, the example angle 200 is less than a 45 degree angle. Such an angle results in the example radial width 155 being less than the example axial height 160 of the contour. An appropriately selected angle 200, of any degree, allows for a sufficient amount of material 162 and a sufficient radial width 139 of the seating surface 135 for seating the flange 45 over the cylinder block 15 to provide axial location control. The example radial width 139 of the seating surface 135 is defined between the boundary 140 and the outer diameter 180 of the flange 45. Compared to a circular contour that has sufficient material 162 for similar thermo-mechanical fatigue strength, the example axial height 160 of the contour can be greater with an elliptical shape while maintaining a sufficient seating surface width 139. An example seating surface width 139 is selected in response to the area of the cylinder liner 20 receiving the load from the cylinder head 25 (as shown in FIGS. 1 & 3). Generally, the example contour 130 can vary in axial width 155, axial height 160, and angle 200 in response to one or more parameters while maintaining the selected seating surface width 139.

In at least one embodiment of the example cylinder liner 20, the measurements of the example ellipse 185 include a major axis 190 having a length about three (3) times the length of minor axis 195, and an angle 200 less than 45 degrees for a liner wall thickness between an inner and outer diameter of about 10 mm. In terms of thermo-mechanical fatigue strength, a comparable cylinder liner with a single, circular radius fillet utilized a liner wall thickness of 12.5 mm. The example cylinder liner 20 and the comparable cylinder liner both include a similar APR groove 85. The example height of the APR groove 85 is selected for one or more of low carbon deposition, improved cooling, and other suitable advantages known to those having ordinary skill in the art to improve engine wear, durability, and emission capability.

In a thermo-mechanical fatigue analysis, the example cylinder liner 20 having example contour 130 defined by the non-circular profile 132 had similar peak cylinder pressure measurement and similar piston side load as said comparable cylinder liner. The example cylinder liner 20 has a reduced bolt preload per bolt by about 60 kN (about 15%) applied as compared to the said comparable liner. The maximum stress seen on the example cylinder liner 20 was lower or improved over said comparable cylinder liner. TMF strength seen on the example cylinder liner 20 was also significantly higher or improved, and the maximum liner temperature in the TRR was reduced by about 50 degrees Celsius (about 20%). The improved maximum liner temperature in the TRR was accomplished with a lower, or improved, fluid coolant flow rate, about 8 gallons per minute less (about 80%).

In short, the example cylinder liner 20 includes a contour 130 defined at least partially by a non-circular profile 132 that facilitates improved performance for use in an internal combustion engine 1. The example cylinder liner 20 in particular provides advantages over a comparable cylinder liner utilizing a single radius circular fillet, such as a thinner liner wall 40, improved structural stress and TMF strength of the liner flange 45, and reduced mass in the fillet and seating regions 120, 125 of the flange.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

The following is claimed:

1. A cylinder liner for an internal combustion engine, comprising:

a liner wall having an outer diameter; and a flange extending radially outward from the liner wall at a superior end of the liner wall, the flange having an inferior surface, the flange including:

a fillet region adjacent to the liner wall and extending radially outward from the liner wall, the inferior surface in the fillet region having a contour, the contour defined at least partially by a non-circular profile; and a seating region extending radially outward from the fillet region, the inferior surface in the seating region structured to engage a cylinder block;

wherein the profile defines a minimum diameter that is greater than or equal to the outer diameter of the liner wall; and wherein the flange has an outer diameter, and wherein an outer end of the contour in the inferior surface in the fillet region meets the inferior surface in the seating region at a transition boundary having a diameter less than the outer diameter of the flange and greater than the minimum diameter of the inferior surface in the fillet region.

2. The cylinder liner of claim 1, wherein a height of the contour in an axial direction is greater than a width of the contour in the radial direction.

3. The cylinder liner of claim 1, wherein the non-circular profile is defined by one of an ellipse, a hyperbola, and a parabola.

4. The cylinder liner of claim 3, wherein the non-circular profile is defined by a slanted ellipse.

5. The cylinder liner of claim 4, wherein the slanted elliptical contour is defined by a major axis and a minor axis, the major axis length equal to about 3 times the minor axis length.

6. The cylinder liner of claim 1, wherein the liner wall includes a sealing region structured to seal the cylinder liner to the cylinder block and define a cooling jacket for holding a fluid, the sealing region having an outer diameter different than the outer diameter of the liner wall.

7. The cylinder liner of claim 1, wherein the liner wall includes a radial control region having an outer diameter greater than the outer diameter of the liner wall.

8. The cylinder liner of claim 7, wherein the radial control region is inferior to the flange.

9. The cylinder liner of claim 1, wherein the liner wall includes an anti-polishing ring (APR) groove at the superior end formed on an inner surface of the liner wall.

10. The cylinder liner of claim 9, wherein a height and a width of the contour are determined in response to the presence of the APR groove.

11. A cylinder in an internal combustion engine, comprising:

a cylinder bore formed in a cylinder block; and a cylinder liner disposed in the cylinder bore, the cylinder liner including:

a liner wall having an outer diameter; and a flange extending radially outward from the liner wall at a superior end of the liner wall, the flange having an inferior surface, the flange including a fillet region and a seating region, the fillet region being adjacent to the liner wall and extending radially outward from the liner wall, the inferior surface in the fillet region having a contour, the seating region extending radially outward from the fillet region, the inferior surface in the seating region structured to engage the cylinder block, the contour being connected at one end to the liner wall and at an opposite end to the inferior surface in the seating region;

wherein the contour defines a minimum diameter that is greater than or equal to the outer diameter of the liner wall and is defined at least partially by a non-circular profile.

12. The cylinder liner of claim 11, wherein the non-circular profile is defined by a slanted ellipse.

13. The cylinder of claim 11, including a piston disposed interior to the cylinder liner to form a combustion chamber between the piston and a portion of a cylinder head that is interior to the cylinder liner.

14. The cylinder of claim 11, including a cooling jacket in the cylinder bore between the cylinder block and the cylinder liner structured to contain a fluid for cooling the liner wall of the cylinder liner.

15. The cylinder liner of claim 14, wherein the liner wall includes a sealing region structured to seal the cylinder liner to the cylinder head to define a boundary of the cooling jacket, the sealing region having an outer diameter different than the outer diameter of the liner wall.

16. The cylinder liner of claim 15, wherein the sealing region is disposed on the liner wall at one of: a location at an inferior end of the liner wall and a location near a middle of the liner wall.

17. The cylinder liner of claim 11, wherein the liner wall includes a radial control region having an outer diameter greater than the outer diameter of the liner wall, the radial control region being inferior to the flange.

18. The cylinder liner of claim 11, further including an anti-polishing ring (APR) disposed at the superior end of the cylinder liner, wherein the liner wall includes an APR groove at the superior end formed on an inner surface of the liner wall.

19. A method of assembling a cylinder, comprising:

providing a cylinder block having a cylinder bore formed therein;

providing a cylinder head;

providing a cylinder liner including:

a liner wall having an outer diameter; and a flange extending radially outward from the liner wall at a superior end of the liner wall, the flange having an inferior surface, the flange including a fillet region and a seating region, the fillet region being adjacent to the liner wall and extending radially outward from the liner wall, the inferior surface in the fillet region having a contour, the seating region extending radially outward from the fillet region, the inferior surface in the seating region structured to engage a cylinder block, the contour being connected at one end to the liner wall and at an opposite end to the inferior surface in the seating region;

wherein the contour defines a minimum diameter that is greater than or equal to the outer diameter of the liner wall and is defined at least partially by a non-circular profile;

inserting the cylinder liner into the cylinder bore of the cylinder block; and clamping the cylinder head over the cylinder bore to compress the seating region of the flange.

20. The method of claim 19, wherein the non-circular profile is defined by a slanted ellipse.

* * * * *